United States Patent [19]

Olbrich et al.

[11] 4,436,614

[45] Mar. 13, 1984

[54] PROCESS FOR DEWAXING AND DESULFURIZING OILS

[75] Inventors: Hazel C. Olbrich, Rodeo; Dennis J. O'Rear, Petaluma; John A. Zakarian, Richmond, all of Calif.

[73] Assignee: Chevron Research Company, San Francisco, Calif.

[21] Appl. No.: 433,620

[22] Filed: Oct. 8, 1982

[51] Int. Cl.[3] ..... C10G 45/02; C10G 65/12

[52] U.S. Cl. ..... 208/89; 208/58; 208/97; 208/111

[58] Field of Search ..... 208/89, 58, 97

[56] References Cited

U.S. PATENT DOCUMENTS

| | | | |
|---|---|---|---|
| Re. 28,398 | 4/1975 | Chen et al. | 208/111 |
| 3,668,113 | 6/1972 | Burbidge et al. | 208/97 |
| 3,700,585 | 10/1972 | Chen et al. | 208/111 |
| 3,894,938 | 7/1975 | Gorring et al. | 208/97 |
| 4,021,330 | 5/1977 | Satchell | 208/89 X |
| 4,149,960 | 4/1979 | Garwood et al. | 208/111 |
| 4,171,257 | 10/1979 | O'Rear et al. | 208/111 |
| 4,213,847 | 7/1980 | Chen et al. | 208/111 |
| 4,229,282 | 10/1980 | Peters et al. | 208/87 X |
| 4,257,872 | 3/1981 | La Pierre et al. | 208/59 |
| 4,394,249 | 7/1983 | Shen | 208/58 |
| 4,415,436 | 11/1983 | Angevine et al. | 208/89 |

*Primary Examiner*—Delbert E. Gantz
*Assistant Examiner*—George Schmitkons
*Attorney, Agent, or Firm*—D. A. Newell; S. R. La Paglia; V. J. Cavalieri

[57] ABSTRACT

A desulfurizing and dewaxing process which can be performed in a single reaction vessel is disclosed.

The desired lowering of oil partial pressure for dewaxing zone is accomplished by adding diluent gas to the HDS-zone effluent, thus obviating the need for other means to maintain differing oil partial pressures between serial catalyst zones.

7 Claims, 1 Drawing Figure

FIGURE

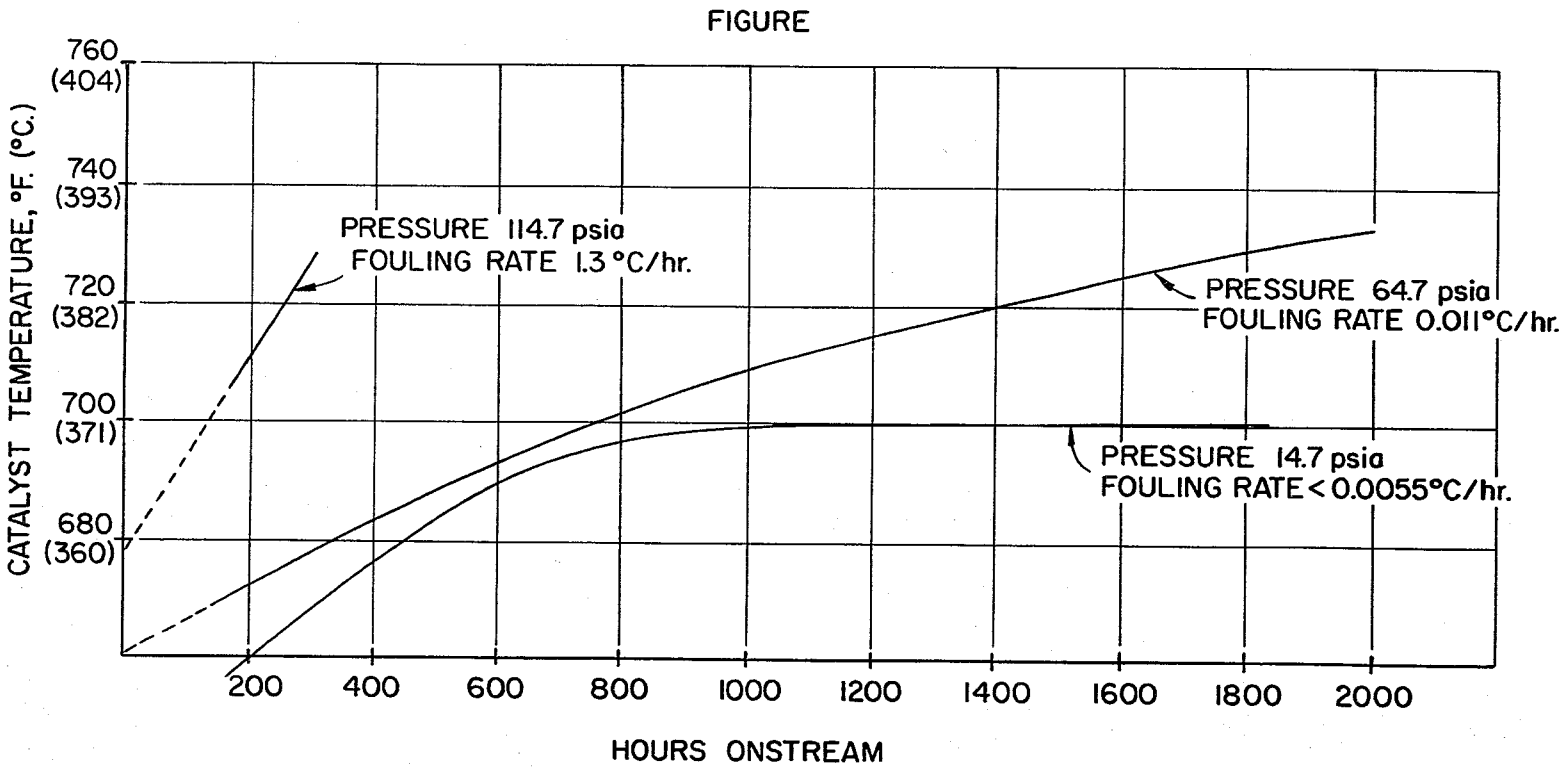
FIGURE

PROCESS FOR DEWAXING AND DESULFURIZING OILS

TECHNICAL BACKGROUND

Our invention relates to the catalytic removal of n-paraffins and organosulfur compounds from materials which contain hydrocarbons. One of the important fractions of crude petroleum is the gas oil fraction. It contains many compounds boiling from 200° C. to 600° C. The importance of this fraction is that it is the primary source of jet and diesel fuel, fuel oils, and lubricating oils. In the future, synthetic fuels produced from coal, shale, tar sands, heavy oils and other sources will produce gas oil range products.

The typical gas oil range feed contains both sulfur compounds and n-paraffins. The organosulfur compounds must be removed to avoid air pollution and corrosion problems. The molecular distribution of n-paraffins must be shifted from higher to lower molecular weights to reduce the pour point of the product so the product can flow under the conditions of use.

Many catalysts and processes have been proposed and used to desulfurize and dewax hydrocarbon containing feeds. U.S. Pat. No. 3,668,113, Burbidge et al., June 6, 1972, discloses a two-step process involving dewaxing with a mordenite catalyst followed by desulfurizing with a Group VI or VIII hydrogenation catalyst. U.S. Pat. No. RE 28,398 of U.S. Pat. No. 3,700,585, Chen et al., Oct. 24, 1972, discloses dewaxing oils using ZSM-5. U.S. Pat. No. 3,894,938, Gorring et al., July 15, 1975, discloses dewaxing a sulfur-containing gas oil with a ZSM-5 catalyst followed by conventional hydrodesulfurizing. U.S. Pat. No. 4,213,847, Chen et al., July 22, 1980, discloses hydrodewaxing in a distillation reaction column. U.S. Pat. No. 4,229,282, Peters et al., Oct. 21, 1980, discloses hydrodewaxing with a catalyst which contains a nickel/tungsten hydrogenation component and a ZSM-5 zeolite. U.S. Pat. No. 4,257,872, LaPierre et al., Mar. 24, 1981, discloses a dual bed process for upgrading refractory hydrocarbon feeds which involves hydrotreating followed by hydrocracking with an alkali-metal poisoned ZSM-5 zeolite.

Several other patents also relate to dewaxing hydrocarbon feeds. U.S. Pat. No. 3,852,189, Chen et al., Dec. 3, 1974, discloses liquid phase dewaxing using ZSM-5 zeolites. U.S. Pat. No. 3,968,024, Gorring et al., July 6, 1976, discloses dewaxing at low pressures using microcrystalline ZSM-5 zeolites. U.S. Pat. No. 4,149,960, Garwood et al., Apr. 17, 1979, discloses dewaxing gas oils using ZSM-5 zeolites and cofed water. U.S. Pat. No. 4,171,257, O'Rear et al., Oct. 16, 1979, discloses upgrading petroleum feeds and producing light olefins using ZSM-5 zeolites at low pressures. U.S. Pat. No. 4,135,540, Gorring et al., May 8, 1979, discloses upgrading shale oil by hydrotreating followed by hydrocracking the hydrotreater effluent with a ZSM-5 zeolite.

TECHNICAL DISCLOSURE

Our discoveries are embodied in a process for treating hydrocarbon containing feeds in a single reaction vessel, comprising:

(a) contacting in a desulfurizing reaction zone a hydrocarbonaceous feed boiling from about 35° C. to 650° C. with a desulfurizing catalyst under desulfurizing conditions which comprise a hydrocarbon partial pressure above about 30 psia (2.07 bar);

(b) mixing the effluent of said desulfurizing reaction zone with a diluent; and (c) contacting said desulfurizing zone effluent and diluent gas mixture with a nonhydrogenative dewaxing catalyst, which comprises an intermediate pore size zeolite, under dewaxing conditions, which comprise a hydrocarbon partial pressure in said mixture of less than about 30 psia (2.07 bar).

The hydrocarbonaceous feed can be any hydrocarbon-containing material which needs to be dewaxed and desulfurized. Examples include feeds boiling from 35° C. to 650° C. such as naphtha, kerosene, diesel fuel, heating fuel, jet fuel, gas oil and lube oil stocks. Those hydrocarbon feeds boiling from 200° C. to 600° C. are particularly suitable as they are typically dewaxed to remove paraffins, to lower pour and freeze points and to produce lube oils and mid-distillate fuels. The usual feed will be a straight run petroleum stock which also contains sulfur. However, any source of hydrocarbonaceous materials can be used, shale oil, tar sand oil, liquefied coal and similar materials, for example.

Sulfur is typically present in the feed as organosulfur compounds at levels of 0.05 to 10 wt. %, while n-paraffins are typically present at levels of 5 to 70 wt. %.

Desulfurizing catalysts are well known to the art. They typically comprise one or more metals and an inorganic oxide support. The catalyst can be prepared using processes well known to the art such as cogelling, ion exchange, impregnation, etc. The inorganic oxide support is usually an oxide of an element of Groups II, III and IV of the Periodic Table or mixtures of them. The preferred support is alumina. The metal hydrogenation component is preferably an oxide or sulfide of a Group VIB metal (i.e., tungsten, molybdenum and chromium) together with one or more oxides or sulfides of the iron group metals (i.e., cobalt, nickel and iron). The amounts may be from 2–25 wt. % of the Group VIB metal, expressed as metal, and 0.1–10% of the iron group metal or metals, also expressed as metal. Preferred catalysts contain molybdenum oxide or sulfide together with oxides or sulfides of cobalt or nickel or both. Desulfurizing catalysts can also include zeolites.

Reaction conditions for desulfurizing are also well known to the art. Typical conditions include temperatures from 300° C. to 450° C., total pressures from 250 psig (264.7 psia; 18.4 bar) to 3000 psig (3014.7 psia; 2080 bar) space velocities from 1 to 20 v/v/hr, and hydrogen rates of 250 to 10,000 SCF/barrel of feed. In any event, the hydrocarbon partial pressure in the feed to the desulfurizing reaction zone is above 30 psia (2.07 bar) and is preferably 100 psia (6.9 bar) to 600 psia (41.3 bar) and more preferably 200 psia (13.8 bar) to 400 psia (27.6 bar). Total pressure is preferably 600 psig (614.7 psia; 42.3 bar) to 1200 psig (1214.7 psia; 83.7 bar).

The entire product of the desulfurizing reaction zone is mixed with a diluent. The reason for adding the diluent is to lower the hydrocarbon partial pressure so that the hydrocarbon partial pressure in the dewaxing zone is less than about 30 psia (2.07 bar). The diluent can be hydrogen or a nonreactive gas such as water or nitrogen. Water is the preferred diluent. The diluent is typically added at a rate of above 0.5 mole of diluent per mole of feed and is preferably from about 0.5 to about 10 moles of diluent per mole of feed. It can be appreciated that lower hydrocarbon partial pressures in the desulfurizing reaction zone can lessen the amounts of diluent necessary.

The entire mixture, including diluent and desulfurizing zone effluent, is then passed over a dewaxing catalyst in a dewaxing reaction zone. Methods for incorporating more than one bed of catalyst in one reaction vessel with gas addition and withdrawal means between the catalyst beds are well known to the art. The reaction conditions in the dewaxing zone are generally the same as for the desulfurizing zone: temperatures are preferably 550° F. (288° C.) to 850° F. (454° C.), total pressures are preferably 600 psig (614.7 psia; 42.3 bar) to 1200 psig (1214.7 psia); 83.7 bar) and LHSV is preferably 0.5 to 10 hr.$^{-1}$. The hydrocarbon partial pressure, however, is less than 30 psia (2.07 bar) in the dewaxing zone where it is above 30 psia in the desulfurizing zone.

The catalyst used in the dewaxing zone contains an intermediate pore size zeolite and the catalyst contains no hydrogenation metals. By describing the dewaxing catalyst as "nonhydrogenative" it is meant that no hydrogenation metals are present on the catalyst. The zeolite can be composited with refractory inorganic oxides or it can be formed into catalyst particles using inorganic binders. It is preferred that the zeolite be composited with inorganic oxides which do not have cracking activity. Preferred matrices include silica and alumina.

By "intermediate pore size molecular sieve", as used herein, is meant molecular sieves having the unique characteristic of being able to differentiate between large molecules and molecules containing quaternary carbon atoms on the one hand, and smaller molecules on the other hand. Thus, the intermediate pore size materials have surprising catalytic selectivities by reason of their effective pore apertures, as well as highly desirable and surprising catalytic activity and stability when compared to the larger pore size crystalline molecular sieves.

By "intermediate pore size," as used herein, is meant an effective pore aperture in the range of about 5 to 6.5 Angstroms when the molecular sieve is in the H-form. Molecular sieves having pore apertures in this range tend to have unique molecular sieving characteristics and to be particularly useful in dewaxing. Unlike small pore size zeolites such as erionite and chabazite, they will allow hydrocarbons having some branching into the molecular sieve void spaces. Unlike larger pore size zeolites such as the faujasites, they can differentiate between n-alkanes and slightly branched alkanes on the one hand and larger branched alkanes having, for example, quaternary carbon atoms.

The effective pore size of molecular sieves can be measured using standard adsorption techniques and compounds of known minimum kinetic diameters. See Breck, *Zeolite Molecular Sieves,* 1974 (especially Chapter 8) and Anderson et al., J. Catalysis 58, 114 (1979), both of which are incorporated by reference.

Intermediate pore size molecular sieves in the H-form will typically admit molecules having kinetic diameters of 5.0 to 6.5 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular sieve, but do not penetrate as quickly and in some cases are effectively excluded. Compounds having kinetic diameters in the range of 6 to 6.5 Angstroms include: cyclohexane (6.0), 2,3-dimethylbutane (6.1), m-xylene (6.1), and 1,2,3,4-tetramethylbenzene (6.4). Generally, compounds having kinetic diameters of greater than about 6.5 Angstroms do not penetrate the pore apertures and thus are not absorbed into the interior of the molecular sieve lattice. Examples of such larger compounds include: hexamethylbenzene (7.1), 1,3,5-trimethylbenzene (7.5), and tributylamine (8.1).

In performing adsorption measurements to determine effective pore size, standard techniques are used. It is convenient to consider a particular molecule as excluded if it does not fill at least 80% of the zeolite pore volume in less than about one hour (p/po=0.5; 25° C.).

The preferred effective pore size range is from about 5.3 to about 6.2 Angstroms. Among the materials falling within this range are ZSM-5 and materials having its lattice structure, as well as the chromia silicate, CZM.

Examples of intermediate pore size silicaceous crystalline molecular sieves include zeolites such as members of the ZSM series, e.g., ZSM-5, ZSM-11, ZSM-12, ZSM-21, ZSM-23, ZSM-35, ZSM-38, and ZSM-48.

Other examples of intermediate pore size molecular sieves include silicalite, as disclosed in U.S. Pat. No. 4,061,724, and "U.S. Pat. No. RE 29,948 organosilicates," as disclosed in U.S. Pat. No. RE 29,948. Intermediate pore size chromia silicates, CZM, are disclosed in U.S. Ser. No. 160,618, Miller, filed June 28, 1980. All of these are incorporated by reference.

The most preferred molecular sieves are those which have the crystal structure and exhibit the X-ray diffraction pattern characteristic of ZSM-5, ZSM-11, and the chromia silicate, CZM. The molecular sieves will preferably have aluminum contents yielding silica:alumina mole ratios of less than about 2000:1.

FIGURE

The FIGURE illustrates the data of Example 2.

EXAMPLE 1

A test was performed using a desulfurizing/dewaxing catalyst containing both zeolite and metal desulfurizing component. A base was made by binding 65% ZSM-5 type zeolite (in the hydrogen form) with 35% alumina. This base was impregnated with a nickel-molybdenum-phosphorus aqueous solution by the incipient wetness technique to make the combination catalyst and was calcined. The catalyst was used to refine a waxy FCC light cycle oil so that it could be used as a diesel fuel component. The feed had the following properties:

| | |
|---|---|
| API Gravity | 14.0 |
| Nominal Boiling Range, °C. | 232–371 |
| Pour Point, °C. | −12 |
| Cloud Point, °C. | −3.3 |
| N—Paraffins, Wt % | 8.9 |
| Sulfur, Wt % | 1.49 |
| P/N/A, LV % | 11/47/42 |

The cycle oil was treated at 1.3 LHSV, 1000 psig (1014.7 psia; 70.1 bar) total pressure, about 250 psia (17.2 bar) hydrocarbon partial pressure, 2500 SCF/B recycle gas and with temperatures between 338° C. and 400° C. The product's properties are listed in Table 1.

TABLE 1

| Catalyst Temperature, °C. | Product Properties Pour Point, °C. | Cloud Point, °C. | S, Wt % | Approximate $H_2$ Consumption, SCF/B |
|---|---|---|---|---|
| 340 | | −9 | 0.3 | 1100 |

TABLE 1-continued

| Catalyst Temperature, °C. | Product Properties Pour Point, °C. | Cloud Point, °C. | S, Wt % | Approximate $H_2$ Consumption, SCF/B |
|---|---|---|---|---|
| 371 | −48 | −23 | 0.05 | 1400 |
| 385 | <−57 | −38 | — | 1200 |
| 400 | <−51 | <−51 | — | 1300 |

Chromatographic analyses of the product gas showed only trace amounts (<0.1 wt.%) of olefins. This catalyst and these reaction conditions consume a relatively large amount of hydrogen. The hydrogen is consumed when the metal component of the dewaxing catalyst saturates the olefins produced by the zeolite dewaxing component. In the refinery, it is highly desirable to reduce hydrogen consumption because hydrogen is expensive and is often difficult to obtain.

EXAMPLE 2

An experiment was performed using separate desulfurizing and dewaxing catalytic components. This prevents the saturation of the olefins made by the dewaxing catalyst and, therefore, lowers the hydrogen consumption. In this experiment, the oil was first desulfurized and then passed over the dewaxing catalyst. For typical desulfurizing, the hydrocarbon partial pressure will be in excess of approximately 30 psia (2.07 bar) and usually is between 200 psia (13.8 bar) and 400 psia (27.6 bar).

A dewaxing catalyst was prepared by mixing 65% ZSM-5 type zeolite (in the hydrogen form) with 35% alumina. The catalyst was extruded and calcined.

A desulfurized oil was dewaxed with the catalyst ZSM-5 catalyst at 14.7, 64.7 and 114.7 psia (1.01, 4.45 and 7.95 bar) hydrocarbon partial pressures and at 6.3 LHSV and with temperatures between 338° C. and 427° C. No hydrogen or other diluent was processed with this feed; therefore, the total pressure and hydrocarbon partial pressure were the same. The feedstock properties are shown below.

| | |
|---|---|
| API Gravity | 35.5 |
| Nominal Boiling Range, °C. | 232–454 |
| Pour Point, °C. | +13 |
| N—Paraffins, Wt % | 14.2 |
| Sulfur, ppm | 5.4 |
| P/N/A by MS | 41.2/49.2/9.6 |
| Polycyclic Index, ppm | 53 |

The catalyst temperature required to maintain the same extent of dewaxing is shown in the FIGURE. As can be seen, high hydrocarbon partial pressures lead to rapid catalyst fouling. As shown by the data in Table 2, high hydrocarbon partial pressures lead to the formation of trace amounts of olefins which boil in the 350° F.+ product and large aromatic compounds as measured by the polycyclic index.

TABLE 2

| Hydrocarbon Partial Pressure, psia (bar) | 14.7 (1.01) | 64.7 (4.45) | 114.7 (7.95) |
|---|---|---|---|
| Fouling Rate, °C./Hr | 0.0055 | 0.011 | 1.3 |
| Hours Onstream | 285–309 | 697–721 | 296–308 |
| Catalyst Temperature, °C. | 354 | 368 | 389 |
| Total Conversion, LV % | 16.45 | 13.64 | 10.95 |
| Less Than 177° C. | | | |
| Saturate $C_1$–$C_4$ Gases, Wt % | 1.63 | 1.85 | .80 |
| Olefinic $C_2$–$C_4$ Gases, Wt % | 4.47 | 2.70 | 1.45 |
| 177° C.+ Product Properties | | | |
| Bromine No. | 3.6 | 3.2 | 14.4 |
| Polycyclic Index, ppm | 65 | 120 | 660 |

As the hydrocarbon pressure increases, the yield of olefinic light gases decreases. When the hydrocarbon partial pressure is kept below about 30 psia, the fouling of the dewaxing catalyst is reduced and the degradation of the fuel product (as measured by the Bromine number and the Polycyclic Index) is reduced to an acceptable level.

Thus, when the dewaxing catalyst, which does not contain metals in this system, is exposed to hydrocarbon partial pressures in excess of approximately 30 psia, (2.07 bar) three undesirable changes occurred: gaseous olefins are not formed, trace olefins and aromatics form in the fuel, and the dewaxing catalyst fouls rapidly. The fuel boiling range olefins and polycyclic aromatics can cause the fuel to be unstable; and the aromatics reduce the combustion quality of the fuel as measured by smoke point, cetane number, or API gravity.

EXAMPLE 3

The gas oil feed of Example 2 was processed at 64.7 psia (4.45 bar) total pressure but with the addition of 2.8 moles of $H_2O$ per mole of oil to reduce the hydrocarbon partial pressure to about 20 psia (1.37 bar). During the experiment, water was intermittently added. The formation of aromatics, as indicated by the Polycyclic Index was reduced with added water as compared to the level formed at 64.7 psia without the added water.

| Catalyst Temp. (°C.) | Polycyclic Index 0 $H_2O$/Oil | 2.8 $H_2O$/Oil |
|---|---|---|
| 413 | 137 | — |
| 414 | — | 116 |
| 419 | 219 | — |
| 426 | — | 95 |

Further, the fouling rate of the catalyst was significantly reduced by the addition of water and the olefin content of the gas (propene in $C_3$ fraction) was higher with the addition of water.

What is claimed is:

1. A process for treating hydrocarbon containing feeds in a single reaction vessel, comprising:

(a) contacting in a desulfurizing reaction zone a hydrocarbonaceous feed boiling from about 35° C. to 650° C. with a desulfurizing catalyst under desulfurizing conditions which comprise a hydrocarbon partial pressure above about 30 psia;

(b) mixing the effluent of said desulfurizing reaction zone with a diluent to form an effluent and diluent gas mixture; and (c) contacting said desulfurizing zone effluent and diluent gas mixture with a nonhydrogenating dewaxing catalyst, which comprises an intermediate pore size molecular sieve, under dewaxing conditions, which comprise a hydrocarbon partial pressure in said mixture of less than about 30 psia.

2. The process of claim 1 wherein said feed boils from about 200° C. to 600° C.

3. The process of claim 1 wherein said desulfurizing conditions comprise a hydrocarbon partial pressure of 100 psia (6.9 bar) to 600 psia (41.3 bar).

4. The process of claim 3 wherein the hydrocarbon partial pressure of said desulfurizing step is from about 200 psia (13.8 bar) to 400 psia (27.6 bar).

5. The process of claim 1 wherein said diluent is water.

6. The process of claim 1 wherein said dewaxing catalyst comprises a molecular sieve having the ZSM-5 lattice and alumina.

7. The process of claim 1 wherein said molecular sieve is in the hydrogen form.

* * * * *